US005945067A

United States Patent [19]

Hibner et al.

[11] Patent Number: 5,945,067

[45] Date of Patent: Aug. 31, 1999

[54] HIGH STRENGTH CORROSION RESISTANT ALLOY

[75] Inventors: Edward Lee Hibner, Ona; William Lawrence Mankins, Huntington, both of W. Va.; Rickey Dale Corn, Willow Wood, Ohio

[73] Assignee: Inco Alloys International, Inc., Huntington, W. Va.

[21] Appl. No.: 09/178,463

[22] Filed: Oct. 23, 1998

[51] Int. Cl.[6] ..... C22C 30/00; C22C 38/44

[52] U.S. Cl. ..... 420/586; 420/586.1

[58] Field of Search ..... 420/586, 586.1, 420/44–49, 53

[56] References Cited

U.S. PATENT DOCUMENTS

| | | | |
|---|---|---|---|
| 3,183,084 | 5/1965 | Heydt | 75/171 |
| 3,420,660 | 1/1969 | Kawahata et al. | 75/122 |
| 4,255,186 | 3/1981 | Rouby et al. | 75/122 |
| 4,358,511 | 11/1982 | Smith, Jr. et al. | 428/595 |
| 4,487,744 | 12/1984 | DeBold et al. | 420/584 |
| 4,685,427 | 8/1987 | Tassen et al. | 122/511 |
| 4,765,956 | 8/1988 | Smith et al. | 420/445 |
| 4,816,217 | 3/1989 | Bassford et al. | 420/582 |
| 5,310,522 | 5/1994 | Culling | 420/585 |

FOREIGN PATENT DOCUMENTS

| | | | |
|---|---|---|---|
| 56-20148 | 2/1981 | Japan | 420/586.1 |
| 60-155653 | 8/1985 | Japan | 420/586.1 |

OTHER PUBLICATIONS

Caynard et al., Serviceability of 13Cr Tubulars in Oil and Gas Production Environments, NACE Paper No. 112, 1998, pp. 1–8.

*Primary Examiner*—Deborah Yee
*Attorney, Agent, or Firm*—Robert F. Dropkin, Esq.; Blake T. Biederman, Esq.

[57] ABSTRACT

The alloy consists of an age hardenable-corrosion resistant alloy useful for oil and gas applications that require resistance to low-level sour gas conditions. This alloy contains, by weight percent, 20 to 36 nickel, 18 to 25 chromium, 1 to 8 molybdenum, 1.2 to 4 titanium, less than 0.5 aluminum, 0.001 to 0.5 carbon, less than 1.5 niobium, less than 10 manganese, less than 5 copper, less than 4 cobalt, less than 0.1 total calcium, cerium and magnesium, 0 to 0.01 boron and balance iron and incidental impurities and deoxidizers.

6 Claims, No Drawings

HIGH STRENGTH CORROSION RESISTANT ALLOY

FIELD OF THE INVENTION

This invention relates to the field of corrosion resistant alloys. In particular, this invention relates to the field of iron-nickel-chromium alloys.

BACKGROUND OF THE INVENTION

Modem Oil Patch applications now require alloys of increasing corrosion resistance and strength. These increasing demands arise from factors including: deep wells that involve higher temperatures and pressures; enhanced recovery methods such as steam or carbon dioxide ($CO_2$) injection; increased tube stresses especially offshore; and corrosive well containments including: hydrogen sulfide ($H_2S$), $CO_2$, and chlorides.

Materials selection is especially critical for sour gas wells—those containing $H_2S$. Sour wells' environments are highly toxic and extremely corrosive to traditional carbon steel oil and gas alloys. In some sour environments, corrosion can be controlled by using inhibitors along with carbon steel tubulars. The inhibitors however, involve continuing high cost and are often unreliable at high temperatures. Adding corrosion allowance to the tubing wall increases weight and reduces interior tube dimensions. In many cases, the preferred alternative in terms of life-cycle economy and safety is the use of a corrosion resistant alloy for tubulars and other well components. These corrosion resistant alloys eliminate inhibitors, lower weight, improve safety, eliminate or minimize workovers and reduce downtime.

Martensitic stainless steels, such as the super 13% chromium alloys satisfy corrosion resistance and strength requirements slightly corrosive oil patent applications. (This specification describes all compositions in weight percent, unless specifically expressed otherwise.) The super 13% alloys however lack the moderate corrosion resistance and strength required of low-level-sour gas wells. Cayard et al., in "Serviceability of 13Cr Tubulars in Oil and Gas Production Environments," published sulfide stress corrosion data that indicate 13Cr alloys have insufficient corrosion resistance for wells that operate in the transition region between sour gas and non-sour gas environments.

Austenitic-high-nickel alloys such as alloys 825, 925, G-3 and C-276 provide alloys with increasing levels resistance to corrosive-sour gas environments. These nickel-base alloys provide the combination of strength and corrosion resistance necessary to act in L. the most demanding Oil Patch applications. Unfortunately, these alloys are often too expensive for low-level-sour gas applications.

It is an object of this invention to provide an alloy with sufficient corrosion resistance to function in low-level-sour gas environments.

It is a further object of this invention to provide an alloy with sufficient mechanical strength to serve in demanding oil and gas tubing applications.

It is a further object of this invention to provide a low-nickel alloy with sufficient strength and corrosion resistance to serve in low-level-sour gas environments.

SUMMARY OF THE INVENTION

The alloy consists of an age hardenable-corrosion resistant alloy useful for oil and gas applications that require resistance to low-level sour gas conditions. This alloy contains, by weight percent, 20 to 36 nickel, 18 to 25 chromium, 1 to 8 molybdenum, 1.2 to 4 titanium, less than 0.5 aluminum, 0.001 to 0.5 carbon, less than 1.5 niobium, less than 10 manganese, less than 5 copper, less than 4 cobalt, less than 0.1 total calcium, cerium and magnesium, 0 to 0.01 boron and balance iron, incidental impurities and deoxidizers.

DESCRIPTION OF PREFERRED EMBODIMENT

The alloy provides a high strength nickel alloy for Oil Patch applications with corrosion resistance and mechanical properties superior to 13% chromium alloys. This alloy relies upon an austenitic matrix containing chromium and molybdenum for corrosion resistance and titanium for age hardening. Heat treating this alloy precipitates a stable gamma prime phase that increases the yield strength of the alloy without a detrimental decrease in low temperature impact strength.

Nickel modifies the iron-base matrix to provide a stable austenitic structure and increases general corrosion resistance of the alloy. At minimum, the alloy contains at least 20% nickel for good corrosion resistance. Nickel levels above 36% result in an alloy having too high of a cost for low-level sour gas applications.

Chromium and molybdenum provide the necessary corrosion resistance for low-level sour gas applications. A minimum of at least 18% chromium achieves the desired minimum corrosion resistance. Chromium levels above 25% can result in the precipitation of detrimental sigma phase or chromium carbides. When chromium levels are in the high range, nickel levels should also be maintained at high levels to stabilize the austenitic matrix.

An addition of at least 1% molybdenum increases pitting resistance and resistance to $H_2S$. Molybdenum levels above 8% decreases workability and increases the cost of the alloy.

Aluminum, niobium and titanium precipitate as gamma prime or gamma double prime phase to age harden the alloy. It has been discovered however that aluminum-containing gamma prime adversely impacts yield strength. In view of this, the alloy advantageously contains a maximum of 0.5% aluminum. Most advantageously, the alloy contains less than 0.3% aluminum. Decreasing aluminum, increases the yield strength of this alloy.

Titanium effectively age hardens the alloy to increase yield strength without adversely impacting low temperature impact strength. A minimum of 1.2% titanium provides sufficient gamma prime upon aging to strengthen the alloy. Titanium levels above 4% however can render this alloy unstable. Titanium levels below 2.4% give this alloy good levels of age hardening without any susceptibility to over-aging.

Niobium optionally provides additional age hardening through gamma double prime precipitation. This alloy can accept up to 1.5% niobium to further strengthen the matrix without adversely impacting corrosion resistance or impact strength.

An amount of at least 0.01% carbon further strengthens the alloy. But excessive quantities of carbon (greater than 0.5%) precipitate detrimental carbides that deteriorate mechanical and corrosion properties.

Cobalt, copper and manganese are optional elements that substitute into the matrix. Cobalt does contribute to solid solution hardening and corrosion resistance. But its high cost make cobalt impractical for this alloy. Copper can contribute resistance to sulfuric acid environments. Copper is unnecessary however for Oil Patch applications. Finally, manganese provides a low-cost substitute for nickel. Unfortunately, substituting manganese for nickel decreases corrosion resistance of the alloy. These alloys can tolerate up to 10% manganese without an unacceptable decrease in corrosion properties.

An optional addition of boron (up to 0.01%) may increase hot workability of the alloy. Excess quantities of boron however reduced the hot workability of the alloy.

Iron plus incidental impurities, such as silicon, tungsten and zinc and deoxidizes, such as calcium, cerium and magnesium comprise the balance of the alloy. When air melting this alloy, it is critical to use deoxidizers. Furthermore, the alloy's mechanical properties improve by introducing calcium, cerium and magnesium in quantities up to 0.1%.

EXAMPLE

This evaluates the effects of (a) alloy Al and Ti content and (b) heat treatment, on the mechanical properties of air melted example heats 1 to 3 and comparative heats A to E.

These heats nominally contained 32% Ni, 21% Cr, 2% Mo, balance Fe, with the Al content varied from 0.030 to 3.00% and the Ti content varied from 0.30 to 3.0%. Material for testing was solution annealed at 2150° F.(1177° C.)/1 h/water quenched (WQ), then evaluated 10 in the following age-hardened conditions: (a) 1350° F.(732° C.)/8 h, furnace cooled (FC) at 50° F.(28° C.)/h, 1150° F.(621° C.)/8 h/air cooled (AC), (b) 1350° F.(732° C.)/12 h, FC at 50° /h (28° C./h), 1150° F.(621° C.)/12 h/AC, and (c) 1250° F.(677° C.)/20 h/AC.

Material for testing came from 0.625 inch (15.9 mm) diameter bar produced from air melted laboratory heats. The 50 lb (23 kg) ingots were homogenized at 2100° F. (1149° C.) for 16 hours prior to hot rolling to 0.625 inch (15.9 mm) diameter. Table 1 displays the chemical composition of the evaluated heats.

TABLE 1

Chemical Composition of Evaluated Heats

| | 1 | 2 | 3 | A | B | C | D | E | F |
|---|---|---|---|---|---|---|---|---|---|
| C | 0.0189 | 0.0176 | 0.0163 | 0.0215 | 0.0214 | 0.0187 | 0.189 | 0.0187 | 0.0213 |
| Mn | 0.11 | 0.11 | 0.11 | 0.12 | 0.012 | 0.11 | 0.12 | 0.12 | 0.11 |
| Fe | 42.16 | 42.57 | 43.00 | 41.21 | 41.04 | 40.38 | 42.70 | 42.24 | 41.58 |
| Si | 0.03 | 0.03 | 0.03 | 0.10 | 0.09 | 0.008 | 0.08 | 0.07 | 0.03 |
| Cu | <0.01 | <0.01 | <0.01 | <0.01 | <0.01 | 0.01 | <0.01 | <0.01 | <0.01 |
| Ni | 33.54 | 32.85 | 31.75 | 32.01 | 31.99 | 32.55 | 32.00 | 32.07 | 32.24 |
| Cr | 21.25 | 21.01 | 20.71 | 21.37 | 20.99 | 20.87 | 21.15 | 21.01 | 20.89 |
| Al | 0.20 | 0.05 | 0.07 | 2.90 | 2.95 | 2.77 | 1.91 | 1.83 | 1.89 |
| Ti | 0.80 | 1.68 | 2.56 | 0.36 | 0.73 | 1.19 | 0.35 | 0.72 | 1.20 |
| Mg | <0.001 | <0.001 | <0.001 | <0.01 | <0.01 | <0.01 | <0.01 | <0.01 | <0.001 |
| Co | 0.01 | <0.01 | <0.01 | <0.01 | <0.01 | <0.01 | <0.01 | <0.01 | 0.01 |
| Mo | 1.86 | 1.76 | 1.75 | 1.84 | 1.86 | 1.96 | 1.63 | 1.89 | 2.00 |
| Nb | <0.01 | <0.01 | <0.01 | 0.01 | 0.01 | 0.01 | 0.01 | 0.01 | <0.01 |
| B | <0.001 | <0.001 | <0.001 | <0.001 | <0.001 | 0.001 | <0.001 | <0.001 | 0.001 |
| Ca | 0.003 | 0.003 | 0.002 | 0.005 | 0.005 | 0.005 | 0.005 | 0.004 | 0.001 |
| Ce | 0.001 | 0.003 | 0.003 | 0.003 | 0.004 | 0.005 | <0.001 | <0.001 | 0.006 |

Table 2 displays the grain size for the 0.625 inch (15.9 mm) diameter bar in the 2150° F.(1177° C.)/1 h/WQ+1250° F.(677° C.)/20 h/AC and the 2150° F.(1177° C.)/1 h/WQ+1350° F.(732° C.)/8 h, FC at 50° F.(28° C.)/h, 1150° F.(621° C.)/8 h/AC annealed plus age-hardened conditions.

TABLE 2

Grain Size for 0.625 inch (15.9 mm) Diameter Solution Annealed Bar

| | | 2150° F.(1177° C.)/ 1 h/ WQ + 1250° F.(677° C.)/ 20 h/ AC | | 2150° F.(1177° C.) 1 h/WQ + 1350° F.(732° C.)/ 8 h, FC at 50° F.(28° C.)/h, 1150° F./8 h/ AC | |
|---|---|---|---|---|---|
| Heat Number | Orientation | Grain Size No. (ASTM) | Grains/mm$^2$ | Grain Size No. (ASTM) | Grains/mm$^2$ |
| 1 | Trans. | 2 | 32 | 2½ | 48 |
| | Long. | 2 | 32 | 2½ | 48 |
| 2 | Trans. | 2 | 32 | 2½ | 48 |
| | Long. | 2½ | 48 | 1½ | 24 |
| 3 | Trans. | 1½ | 24 | 2½ | 48 |
| | Long. | 1½ | 24 | 2½ | 48 |
| A | Trans. | 1½ | 24 | 2½ | 48 |
| | Long. | 1½ | 24 | 2½ | 48 |

TABLE 2-continued

Grain Size for 0.625 inch (15.9 mm) Diameter Solution Annealed Bar

| Heat Number | Orientation | 2150° F.(1177° C.)/ 1 h/ WQ + 1250° F.(677° C.)/ 20 h/ AC | | 2150° F.(1177° C.) 1 h/WQ + 1350° F.(732° C.)/ 8 h, FC at 50° F.(28° C.)/h, 1150° F./8 h/ AC | |
|---|---|---|---|---|---|
| | | Grain Size No. (ASTM) | Grains/mm$^2$ | Grain Size No. (ASTM) | Grains/mm$^2$ |
| B | Trans. | 2 | 32 | 2 | 32 |
| | Long. | 2 | 32 | 2 | 32 |
| C | Trans. | 2 | 32 | 2 | 32 |
| | Long. | 2 | 32 | 2 | 32 |
| D | Trans. | 1 | 16 | 1½ | 24 |
| | Long. | 1 | 16 | 1½ | 24 |
| E | Trans. | 1½ | 24 | 2 | 32 |
| | Long. | 1½ | 24 | 2 | 32 |
| F | Trans. | 1 | 16 | 1 | 16 |
| | Long. | 1 | 16 | 1 | 16 |

Note: All of the heats contained normal grains.

Typical microstructures for the heats contained small intragranular nitride precipitates visible at 50× magnification.

Table 3 displays mechanical properties for solution annealed plus age-hardened 0.625 inch (15.9 mm) diameter bar.

TABLE 3

Mechanical Properties for 15.9 mm Diameter Solution Annealed plus Aged Bar

| Heat No. | Heat Treated Condition | Room Temperature Tensile Properties YS (MPa) | ULT (MPa) | % RA | % EL | Hardness HRB, (HRC) | −59° C. CVN Impact Test Results, Energy, joules |
|---|---|---|---|---|---|---|---|
| 1 | a | 194 | 563 | 70.5 | 48.9 | 71 | * |
| | b | 194 | 562 | 72.8 | 49.8 | 71 | * |
| 2 | a | 623 | 954 | 53.2 | 30.4 | (28) | 129;130;136 |
| | b | 610 | 960 | 44.6 | 27.2 | (26) | 126;132;122 |
| | c | 359 | 846 | 61.0 | 42.8 | 95 (16) | 201;183;203 |
| 3 | a | 658 | 1085 | 48.0 | 32.7 | (35) | 106;104;107 |
| | b | 814 | 1143 | 31.1 | 23.9 | (36) | 98;95;95 |
| | c | 422 | 910 | 59.8 | 43.7 | 99 (21) | 164;174;203 |
| A | a | 406 | 840 | 49.0 | 35.5 | 94 (15) | 122;119;115 |
| | c | 322 | 738 | 60.4 | 48.5 | 89 (8) | 199;201;226 |
| B | a | 475 | 911 | 45.7 | 37.6 | 100 (23) | 98;98;102 |
| | c | 383 | 792 | 63.4 | 48.6 | 94 (15) | 206;217;220 |
| C | a | 524 | 965 | 45.5 | 37.1 | (29) | 115;108;113 |
| | c | 431 | 845 | 60.0 | 46.6 | 96 (17) | 194;202;207 |
| D | a | 271 | 667 | 60.4 | 49.6 | 79 | 251;256;285** |
| | c | 285 | 708 | 66.3 | 45.0 | 85 (3) | 158;255;262 |
| E | a | 382 | 856 | 52.6 | 37.4 | 93 (13) | 163;157;146 |
| | c | 318 | 749 | 62.8 | 46.5 | 90 (21) | 231;247;245 |
| F | a | 435 | 928 | 50.1 | 37.6 | 97 (19) | 172;140;148 |
| | c | 359 | 810 | 62.1 | 48.2 | 93 (13) | 199;210;183 |

Heat Treated Condition: (a) 1177° C./1 h/WQ + 732° C./8 h, FC at 28° C./h, 621° C./8 h/AC (b) 1177° C./1 h/WQ + 732° C./12 h, FC at 28° C./h, 621° C./12 h/AC (c) 1177° C/1 h/WQ + 677° C./20 h/AC

*Specimens did not break.

**Calibration limit of machine is only 260 joules.

The yield strengths material age-hardened as above ranged from 88.4 to 118.0 ksi (610 to 814 MPa) and the −75° F. (−59° C.) CVN impact strengths ranged from 70 to 100 ft-lbs (95 to 136 joules). When heat treated at 2150° F./1 h/WQ+1250° F./20 h/AC, heats HF8104 and HF8105 exhibited yield strengths of=62 ksi (427 MPa). The −75° F. (−59° C.) CVN impact strengths ranged from 121 to 150 ft-lbs (164 to 203 joules). The test bars from heats 2 and 3 in the 1350° F.(732° C.)/8 h, FC at 50° F.(28° C.)/h, 1150° F.(621° C.)/8 h/AC and 1350° F.(732° C.)/12 h, FC at 50° F.(28° C.)/h, 1150° F.(621° C.)/12 h/AC age-hardened conditions had the best minimum yield strength and impact strength—these heats contain about 0.1% Al, with 1.68 to 2.56% Ti.

The comparative heats, which contained high aluminum (1.83 to 2.95%) and low titanium (0.36 to 1.20%), exhibited less than an 80 ksi yield strength when evaluated in the various heat treated conditions. The yield strengths ranged from 28.1 to 76.0 ksi (194 to 524 MPa). The −75° F. (−59° C.) CVN impact strengths ranged from 80 to ~200 ft-lbs (108 to ~271 joules), compared to the required minimum of 25 ft-lbs (34 joules).

This alloy anneals by solution treating at a temperature of at least about 1750° F. (955° C.) and less than about 2250° F. (1232° C.) followed by either air-cooling or water quenching. It may be necessary to anneal after casting and after critical amounts or either hot working or cold working. This solution treatment also prepares the alloy for aging.

After annealing, a gamma prime precipitation treatment strengthens the alloy. Aging the material for at least 4 hours, e.g. 4 to 30 hours at a temperature of at least about 1275° F. (69 1° C.) precipitates sufficient gamma prime to strengthen the alloy. Most advantageously, a secondary age follows this initial age to precipitate a fine-structured gamma prime. Fumace-cooling the alloy to about 1050° F. to 1250° F.(565 to 677° C.) and holding the alloy at temperature for about 4 to 20 hours followed by air-cooling maximizes the gamma prime strengthening. A typical heat treatment of the alloy consists of an anneal at a temperature of about 2125 to 2175° F. (1163 to 1190° C.) for 0.5 to 4.5 hours, age hardening at a temperature of about 1300 to 1400° F. (704 to 760° C.) for 5.5 to 12.5 hours, furnace-cooling, secondary age hardening at a temperature of 1100 to 1200° F. (593 to 649° C.) for 5.5 to 12.5 hours and air cooling to temperature.

Alternatively, it is possible to age the alloy with a single-step process at a temperature above about 1200° F. (649° C.) for at least 4 hours, e.g. about 4 to 30 hours, followed by air-cooling. A typical heat treatment of this consists of an anneal followed by age hardening at about 1200 to 1400° F. (649 to 760° C.), for 4 to 30 hours.

The high titanium alloy of the invention possesses greater than sufficient corrosion resistance to survive in low-level-sour gas environments. The common pass fail criteria for slow strain rate (SSR) corrosion tests is a ration of the time to failure (TTF), percent reduction of area (RA) or percent elongation (EL) measured in a simulated Oil Patch environment relative to the same parameter in an inert environment such as air or nitrogen. Depending on the alloy and the environment, a ratio of 0.70 or greater typically passes. Furthermore, all specimens must also show no secondary cracking (SC), away from the primary cracking, in the gage length. The absence of secondary cracking also indicates good stress corrosion cracking resistance. Each lot of material must pass all of the above tests for release into sour gas applications.

Table 4 below provides a summary of SSR data evaluated in a sour brine environment that simulates Oil Patch conditions with 15% NaCl, 0.435 psi (0.03 bar) $H_2S$, 700 psi (48.3 bar) $CO_2$, pH 4.0 and a temperature of 194° F. (90° C.).

TABLE 4

| Slow Strain Rate Corrosion Data | | | | |
|---|---|---|---|---|
| Heat No. | TTF Ratio | RA Ratio | EL Ratio | SC |
| 2 | 1.01 | 0.85 | 1.01 | No |
| 3 | 0.81 | 0.80 | 0.78 | No |
| | Avg. 0.91 | Avg. 0.83 | Avg. 0.90 | |

In addition to easily passing the above corrosion test, these heats also passed hydrogen embrittlement test TM0177, Method A, for constant load specimens tested at 100% of the 0.2% yield strength for 720 hours galvanically coupled to steel in a sour brine simulated Oil Patch environment. This tested resistance to sulfide stress cracking in $H_2S$ environments-one of the most severe forms of hydrogen embrittlement.

Table 5 below provides the ranges of elements that "about" correspond to this alloy.

TABLE 5

| | BROAD | INTERMEDIATE | NARROW |
|---|---|---|---|
| Ni | 20–36 | 25–35 | 26–34 |
| Cr | 18–25 | 19–24 | 20–23 |
| Mo | 1–8 | 1.5–7 | 1.8–6 |
| Ti | 1.2–4 | 1.5–3.5 | 1.7–3 |
| Al | 0–0.5 | 0–0.4 | 0–0.3 |
| C | 0.001–0.5 | 0.002–0.2 | 0.005–0.1 |
| Nb | 0–1.5 | 0–1.2 | 0–1 |
| Mn | 0–10 | 0–5 | 0–2 |
| Cu | 0–5 | 0–3 | 0–1 |
| Co | 0–4 | 0–2 | 0–1 |
| Ca, Ce, Mg | 0–0.1 | 0–0.05 | 0–0.01* |
| B | 0–0.01 | 0–0.005 | 0–0.001 |
| Fe | Balance** | Balance** | Balance** |

* = Total Ca + Ce + Mg
** = Plus incidental impurities and deoxidizers.

This age hardenable alloy provides the corrosion resistance and strength necessary for low-level sour gas Oil Patch applications unacceptable for super 13% alloys. This corrosion resistance allows extended operation in sour gas Oil Patch applications without a significant decrease in mechanical properties or secondary cracking. Furthermore, the alloy has excellent resistance to hydrogen embrittlement under sour gas conditions. In summary, this alloy's high yield strength and impact strength allow relatively thin sections to serve in demanding high strength tubing applications that only high-nickel alloys could serve.

In accordance with the provisions of the statute, this specification illustrates and describes specific embodiments of the invention. Those skilled in the art will understand that the claims cover changes in the form of the invention and that certain features of the invention may operate advantageously without a corresponding use of the other features.

We claim:

1. An age hardenable-corrosion resistant alloy consisting essentially of by weight percent, about 25 to 35 nickel, about 19 to 24 chromium, about 1.5 to 7 molybdenum, about 1.5 to 3.5 titanium, less than about 0.4 aluminum, about 0.002 to 0.2 carbon, less than about 1.2 niobium, less than about 5 manganese, less than about 1 copper, less than about 2 cobalt, less than about 0.05 total calcium, cerium and magnesium, about 0 to 0.005 boron and balance iron and incidental impurities and deoxidizers; and said alloy passing a slow strain rate corrosion test by maintaining a ratio of at least 0.70 for time to failure, percent reduction in area and elongation for sour brine conditions of 15% NaCl, 0.435 psi $H_2S$, 700 psi $CO_2$, pH 4.0 and a temperature of 194° F.

2. The alloy of claim 1 containing about 26 to 34 nickel, about 20 to 23 chromium and about 1.8 to 6 molybdenum.

3. The alloy of claim 1 containing about 1.7 to 3 titanium, less than about 0.3 aluminum and about 0 to 1 niobium.

4. The alloy of claim 1 having a yield strength of at least about 522 MPa and a Charpy V-notch impact strength at a temperature of −59° C. of at least about 34 joules.

5. An age hardenable-corrosion resistant alloy consisting essentially of, by weight percent, about 26 to 34 nickel, about 20 to 23 chromium, about 1.8 to 6 molybdenum, about 1.7 to 3 titanium, less than about 0.3 aluminum, about 0.005 to 0.1 carbon, less than about 1 niobium, less than about 2 manganese, less than about 1 copper, less than about I cobalt, less than about 0.01 total calcium, cerium and magnesium, about 0 to 0.001 boron and balance iron and incidental impurities and deoxidizers; and said alloy passing a slow strain rate corrosion test by maintaining a ratio of at least 0.70 for time to failure, percent reduction in area and elongation for sour brine conditions of 15% NaCl, 0.435 psi $H_2S$, 700 psi $CO_2$, pH 4.0 and a temperature of 194° F.

6. The alloy of claim 5 having a yield strength of at least about 522 MPa and a Charpy V-notch impact strength at a temperature of −59° C. of at least about 34 joules.

* * * * *